United States Patent [19]

Mandrell

[11] Patent Number: 4,630,981

[45] Date of Patent: Dec. 23, 1986

[54] APPARATUS FOR RESTRAINING CONTAINERS IN A RAILWAY CAR

[75] Inventor: Richard J. Mandrell, St. Charles, Mo.

[73] Assignee: ACF Industries, Incorporated, Earth City, Mo.

[21] Appl. No.: 643,983

[22] Filed: Aug. 24, 1984

[51] Int. Cl.[4] ..... B60P 1/64

[52] U.S. Cl. ..... 410/91; 410/69

[58] Field of Search ..... 410/69, 70, 71, 72, 410/73, 77, 78, 80, 90, 91, 107, 111, 52, 54, 84

[56] References Cited

U.S. PATENT DOCUMENTS

| | | | |
|---|---|---|---|
| 3,259,400 | 7/1966 | Tantlinger et al. | 410/90 |
| 3,357,371 | 12/1967 | Gutridge | 410/52 |
| 3,401,646 | 9/1968 | O'Leary | 410/72 |
| 3,439,821 | 4/1969 | Hand | 410/80 |
| 3,486,787 | 12/1969 | Campbell | 410/80 |
| 3,545,713 | 12/1970 | Mowatt-Larsen et al. | 248/361 |
| 3,559,943 | 2/1971 | Hammond et al. | 248/361 |
| 3,717,372 | 2/1973 | Carr | 296/35 A |
| 3,734,308 | 5/1973 | Pasternack | 214/10.5 R |
| 3,737,135 | 6/1973 | Bertolini | 248/361 R |
| 3,894,494 | 7/1975 | Erith et al. | 410/83 |
| 4,077,331 | 3/1978 | Verde | 410/81 |
| 4,082,052 | 4/1978 | Looks | 114/75 |
| 4,091,742 | 5/1978 | Cordani | 410/94 |
| 4,102,274 | 7/1978 | Feary et al. | 410/50 |
| 4,125,077 | 11/1978 | Baaso | 410/82 |
| 4,236,853 | 12/1980 | Niggemeier et al. | 410/76 |

*Primary Examiner*—Robert B. Reeves
*Assistant Examiner*—Donald T. Hajec
*Attorney, Agent, or Firm*—Polster, Polster and Lucchesi

[57] ABSTRACT

A railway car (10) for transporting containers of various lengths and widths, which are shiftable longitudinally, laterally, or both, within the car is provided. To restrain the various size containers a plurality of openings (52, 52', 54, 54', 56, 56', 58, 58', 60, 60', 62, 62') are formed in the floor (50) of the car. The location of the openings is determined by the lengths and widths of the various containers to be carried by the car. A plurality of restraining pins (64, 66, 68, 70) automatically extend up into the floor (50) of the car through the openings in register with the pins. The containers include corner units (80) at each bottom corner thereof with corner openings therein in which a restraining pin is received. The container is loaded onto the car, and the pins are located in container openings corresponding to the corners of a particular length the width of container to be transported, and pins located beneath the respective openings in the corner unit extend upwardly and are received in their respective openings and any pin not in register with an opening, but covered by the corner unit or the container, is automatically depressed by the bottom of the corner unit.

1 Claim, 6 Drawing Figures

APPARATUS FOR RESTRAINING CONTAINERS IN A RAILWAY CAR

BACKGROUND OF THE INVENTION

In U.S. Pat. No. 4,091,742 a well hole railway car is disclosed for carrying containers.

However, this construction does not provide a means of preventing containers smaller than the well hole from sliding about in the well hole which may result in damage to the container and/or the well hole car.

For example, containers are commonly transported in sizes of forty-five feet × eight feet, six inches; forty-five feet × eight feet; forty feet × eight feet, six inches; and forty feet × eight feet. Unless some restraining structure is provided, those containers smaller than forty-five feet × eight feet, six inches will slide about the car.

SUMMARY OF THE INVENTION

The object of the present invention is to provide a means of restraining containers of smaller size than the side and end walls of a container car, while at the same time allowing the use of the full available space to transport large containers.

A railway car for transporting containers of various lengths and widths, which are shiftable longitudinally, laterally, or both, within the car is provided. To restrain the various size containers a plurality of openings are formed in the floor of the car. The location of the openings is determined by the length and width of the various containers to be carried by the car. A plurality of restraining pins extend up into the floor of the car through the openings. A first size container includes corner units at each bottom corner thereof having corner openings therein within which a respective restaining pin is received as the first size container is loaded into the car. The pins are located so as to be in register with container openings corresponding to the corners of a particular length and width of the first size container. Any pins located in the floor for registration with openings in the corner units for other sizes of containers are depressed by the bottoms of the corner units of the first size container as it is loaded into the car.

IN THE DRAWINGS

DESCRIPTION OF PREFERRED EMBODIMENTS

Figure 1:
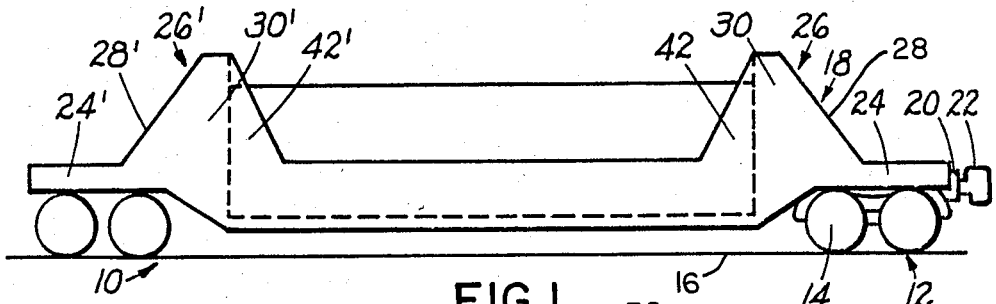
FIG. 1 is a side elevation view of the railway car of the present invention.
Figure 2:
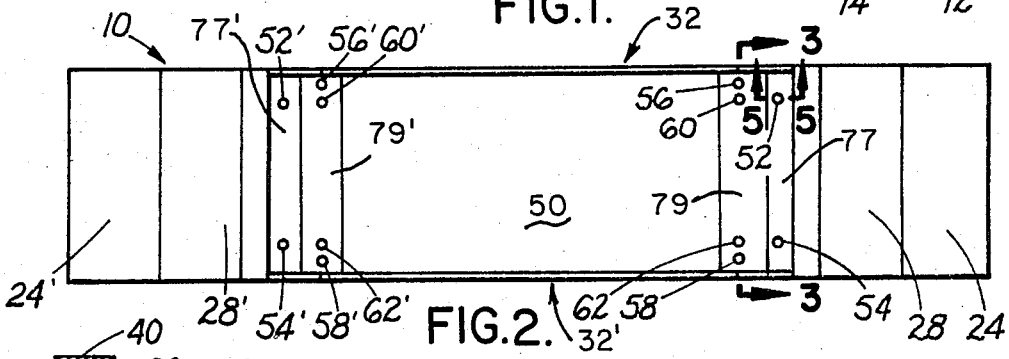
FIG. 2 is a plan view of FIG. 1.

The railway car of the present invention is indicated in the drawings generally at 10. This railway car includes longitudinally spaced trucks 12 having wheels 14 which support the car upon a track 16. The car body indicated at 18 includes a stub sill 20 which houses a conventional coupler 22. The car body 18 is supported on the truck 12 through a conventional center plate connection (not shown).

As described in greater detail in U.S. Pat. No. 4,091,742, the well hole car body 18 includes an end portion 24, 24', and an end bulkhead section 26, 26' including an inclined bulkhead portion 28, 28' and a vertically extending bulkhead 30, 30'.

The car further includes car body sides 32,32' which include longitudinally extending laterally spaced side sills 34, 34' of angle shape. A vertically extending inner wall 36, 36' is provided and an outer wall 38, 38' extends from the side sill 34, 34' upwardly to a transversely extending angle cap 40. At each end of the car inclined side portions 42,42' extend up and join respective bulkhead portions 26, 26'.

A car bottom 50 includes channel members 77, 77', 79, 79', respectively, having a plurality of selected openings 52, 52', 54, 54', 56, 56', 58, 58', 60, 60', and 62, 62'. More or less openings may be provided depending upon the sizes of containers to be transported.

Figure 3:
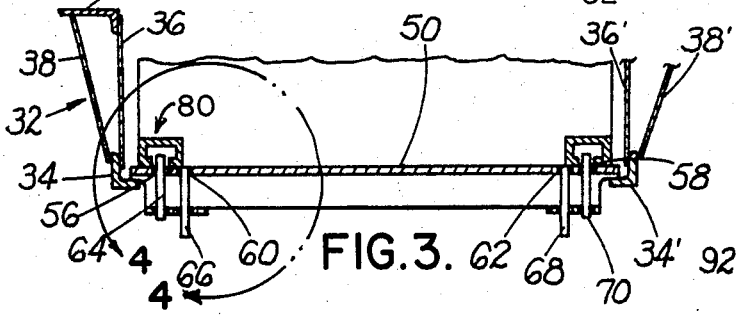
FIG. 3 is a vertical sectional view looking in the direction of the arrows along the line 3—3 in FIG. 2.
Figure 4:
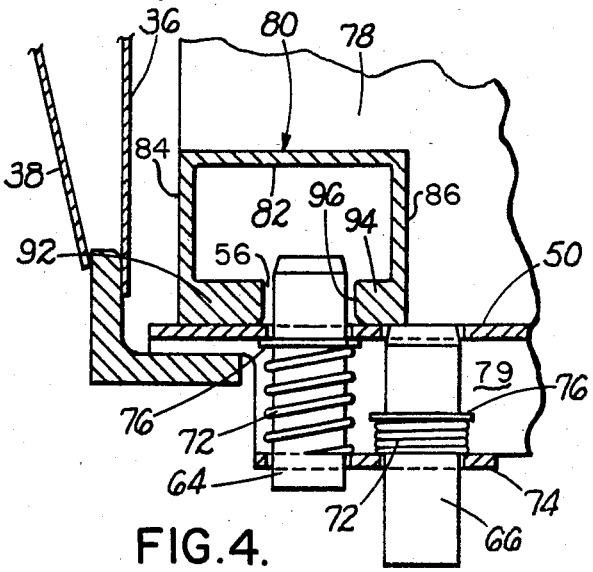
FIG. 4 is an enlarged view of a portion of FIG. 3.

As shown in FIGS. 3 and 4, located within each of the openings is a corresponding container attachment pin 64, 66, 68 or 70. As shown in FIG. 4 pin 64 is located within and below opening 56. Pin 66 are located within and below openings 60. Pin 68 are located within and below opening 62 and pins 70 are located within and below opening 58.

Figure 5:
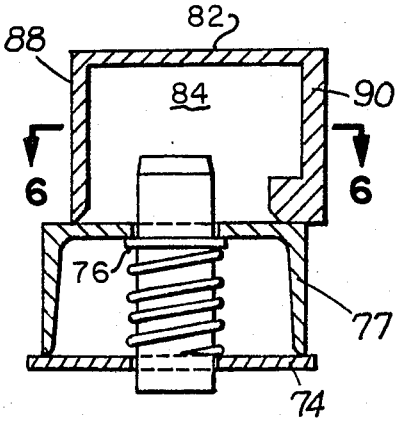
FIG. 5 is a vertical sectional view looking in the direction of the arrows along the line 5—5 in FIG. 2.

As shown in FIGS. 4 and 5 each of the pins is surrounded by a spring 72 which is trapped respectively between channel shaped plate 77, 77', 79, 79' and a bottom plate 74.

The springs 72 engage a spring plate 76 when the pins are in the extended position. Channel plates 79, 79' are welded to bottom 50. Plates 77, 79' are welded to plates 79, 79'.

Each of the containers 78 has a corner foot 80 at each corner thereof which includes a top plate 82, and longitudinally extending wall portions 84 and 86 which are joined by transversely extending wall portions 88 and 90. As shown in FIG. 4 the longitudinally extending wall portions 84 and 86 have outwardly extending extensions 92 and 94. A slot 96 is defined between the extensions. It is significant to note that when the container foot 80 is in place over the opening 56, the pin 64 extends into the opening 56 and into the container foot 80. Further, the extension portion 94 of the foot depresses the pin 66 received in opening 60 with the spring plate 76 depressing the spring 72, as shown in FIG. 4. If the pins are two inches in diameter and a space of one inch is provided between pins 64 and 66, a proper dimensional relationship exists whereby the pin 66 will be depressed when pin 64 is received within slot 96 of corner foot 80.

Figure 6:
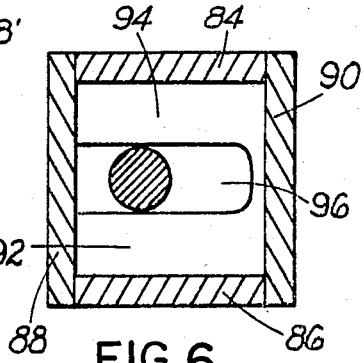
FIG. 6 is a horizontal sectional view looking in the direction of the arrows along the line 6—6 in FIG. 5.

The position shown in FIG. 4 corresponds to a wide container, for example, eight feet, six inches. If a less wide container, for example of eight feet, were to be transported, pin 66 would be extended into the slot 96 and pin 64 depressed by foot extension 92. As shown in FIG. 6 this arrangement does provide a small amount of longitudinal movement of the containers relative to the pins. However, in an effort to make an elongated pin and elongated spring would necessitate expensive supply problems. Therefore the small amount of movement is tolerable when compared with the design problem of attempting to utilize elongated pins and elongated springs.

Operation

The use of the present invention will now be described. If it is desired, for example, to carry containers having a length of forty-five feet and a width of eight feet, six inches (i.e., a first or largest size container), the pins below openings 52, 54, 52′, 54′ would be depressed and the container held in place by the side and end walls of the car.

If it is desired to carry a container having a length of forty-five feet and a width of only eight feet (i.e., i.e., a second size container), the pins located below inboard openings 52, 54, 52′ and 54′ will extend into openings 56 of the container feet 80 as illustrated in FIG. 4, and the container will be restrained from moving laterally by these pins. The end walls 30, 30′ will prevent longitudinal movement.

If it is desired to carry a third size container having a length of forty feet and a width of eight feet, six inches, the pins below openings 60, 62, and 60′, 62′ will be depressed and the pins extending from openings 56, 58 and 56′, 58′ will extend into the container feet 80 as shown in FIG. 4. This will prevent significant longitudinal movement of the container. The side walls 36, 36′ will prevent lateral movement.

If a container having a length of forty feet has a width of eight feet, constituting a fourth size container, the pins below openings 56, 58, 56′ and 58′ will be depressed by the portions 92 of corner feet 80 of the shorter, narrower fourth size container, and the pins located below openings 60, 62, 60′ and 62′ will extend into the corner feet 80 of this shorter, narrower fourth size container. For containers of this shorter, narrower fourth size size, the pins prevent both longitudinal and lateral movement of the containers. Thus the arrangement of the present invention provides flexibility in transporting containers of various sizes in the car.

What is claimed is:

1. Apparatus for securing any one of four standard size containers in a railway car so as to substantially restrain the container against lateral and longitudinal movement with respect to the railway car, said containers having one of two standard lengths including a longest and a shorter length and one of two standard widths including a widest and a narrower width, said car having a bottom on which said container rests, a side wall extending above said bottom at each side thereof, said side walls being spaced apart only somewhat wider than the width of said standard widths, and an end wall at each end of said car, said end walls extending above said car bottom and being spaced apart from one another a distance only somewhat greater than the longest of said standard lengths, said container having a container foot at each corner thereof, each corner foot having an opening in the bottom face thereof, a plurality of pins carried by said car bottom and being spaced for reception in said corner feet openings of said corner feet of certain of said containers, a first standard size container of said longest length and said widest width being restrained against lateral and longitudinal movements by said side walls and said end walls, a second standard container of said longest length and said narrower width being restrained against longitudinal movement by said end walls and being restrained against lateral movement by a first set of said pins, a third standard size container of said shorter length and said wider width receiving a second set of said pins within said corner openings thereby to restrain said third container against longitudinal movement with respect to said car, said third container being restrained against lateral movewment by said side walls, and with a fourth standard size container of said shortest length and narrowest width receiving a third set of said pins within the corner foot openings thereby to restrain said fourth container against both longitudinal and lateral shifting with respect to said car, said pins being resiliently depressable into said car bottom upon a container bearing thereon such that when one of said four standard size containers is loaded onto said car, its respective set of pins is spaced for reception in the openings of the bottom feet castings thereof, and such that the remaining pins in engagement with the bottom of the one standard size container are resiliently depressed into the car bottom.

* * * * *